United States Patent [19]

Marino

[11] Patent Number: 4,572,530

[45] Date of Patent: Feb. 25, 1986

[54] RIDE-ON CONVERTIBLE ROBOT

[76] Inventor: Joseph A. Marino, S. Ryland Rd., P.O. Box 306, Whitehouse, N.J. 08888

[21] Appl. No.: 712,568

[22] Filed: Mar. 15, 1985

[51] Int. Cl.[4] ..... A63G 19/00

[52] U.S. Cl. ..... 280/1.185; 180/209; 280/1.13

[58] Field of Search ..... 280/1.13, 1.165, 1.175, 280/1.188, 1.189, 1.201, 1.208, 1.22; 180/167, 209; 446/289, 290, 291

[56] References Cited

U.S. PATENT DOCUMENTS 4,098,517 7/1978 Sortini ..... 280/1.188

4,264,080 4/1981 Kassai ..... 280/1.13

*Primary Examiner*—Joseph F. Peters, Jr.

*Assistant Examiner*—Donn McGiehan

*Attorney, Agent, or Firm*—Paul Maleson

[57] ABSTRACT

A ride-on convertible robot toy. The toy is large enough to serve as a child's riding car. It has articulated arms and hands that may be operated to grasp objects. The toy is convertible from the ride-on configuration to an erect robot-like configuration, in which it also may be rolled. The toy latches into either configuration and may be unlatched for conversion by pressing down on a knob protruding from the top of the head. In the ride-on configuration, the toy may be steered. The arm wheels are concealed within the body when the toy is in the upright configuration.

15 Claims, 11 Drawing Figures

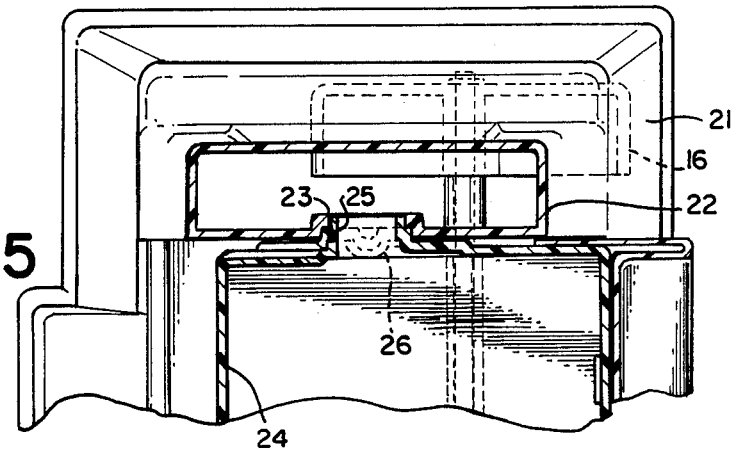
FIG. 5
FIG. 6
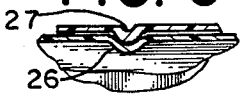
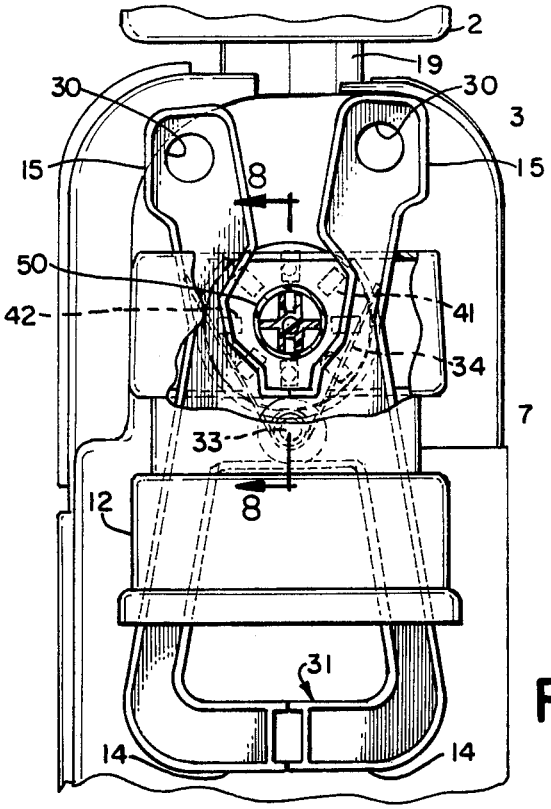
FIG. 7

RIDE-ON CONVERTIBLE ROBOT

BACKGROUND OF THE INVENTION

1. Field of the Invention

This invention relates to toys. More particularly, it relates to toys of the type having sufficient size, strength, and structural aspects which permit them to be used as ride-on vehicles by young children. More particularly, it relates to a ride-on toy which presents the specific appearance of a robot on all fours in its rideable configuration, and which may be converted by the child to an upright free-standing articulated robot-appearing toy.

2. Prior Art

Ride-on toys of many kinds are very well known in the art. For example, they include devices which may be described as kiddie cars, scooters, various kinds of tricycles and the like. It is well known to decorate these in many ways. Toys which give the appearance of robots or mechanical men are likewise well known in and of themselves. Also, it is well known to have small hand-held toys which may be altered by the user from a robot-like upright position to a horizontal automobile-like position. Such devices are sometimes called "transformers". Such prior devices however have not contemplated the function of a ride-on toy suitable for bearing the weight of a child, or suitable for being steered. The structure of such earlier known expedients have, to the best of applicant's knowledge and belief, been of a type that is appropriate for hand-manipulation of hand-held small size toys, and has not been of a type suitable or even contemplating the present structure.

SUMMARY OF THE INVENTION

A ride-on convertible robot-like toy is provided. In one configuration, the robot-like toy stands upright. It is on the order of twenty seven inches high. The exact height is not in itself critical, but the order of magnitude of that height is in keeping with the intended inventive concept of having a convertible robot which is suitable for being ridden upon by a child. A dimension that greatly exceeds or is greatly lesser than this approximate dimension would not be consistent with the overall inventive attempt if it did not permit the riding function by a child.

In its upright robot-like configuration, the preferred embodiment preferably has at least partially articulated arms, and at least partially articulated hand or claw-like appendages, and stands and rolls in a stable manner, preferably upon three wheels in its base.

In the preferred embodiment, preferably, a child may convert the upright robot-like configuration to a riding toy, by pressing on a release mechanism (preferably a knob on the top of the head), and tilt the structure so that the upright back of the robot becomes a horizontal saddle-like structure, the head becomes a pommel-like structure, the ears become grasping and steering handles, the arms become like front legs, and additional wheels appear from the previously concealed position within the body of the robot to become front wheels, and these front wheels are steerable. The child may convert the robot from one configuration to the other at will.

BRIEF DESCRIPTION OF THE DRAWINGS

The invention is best understood in connection with the accompanying drawings in which:

FIG. 5 is a cross-sectional view, partially fragmented, taken along line 5—5 of FIG. 4;

FIG. 6 is a cross-sectional view, partially fragmented, taken along line 6—6 of FIG. 4;

FIG. 7 is a side elevational view, partly fragmented, and partly broken away to show interior structure, of one of the arm and hand assemblies of the device;

DESCRIPTION OF THE PREFERRED EMBODIMENT

The device may be described as a ride-on robot. More specifically, the invention is a device that has two distinct conditions which are freely convertible from one to the other. In one condition, the device is an erect robot-like figure having various degrees of mobility and articulation. In its preferred embodiment it is approximately 27 inches tall. A more particular description is made below of its characteristics in this form. The overall appearance and general function and utility of the device in the erect form is best shown in FIG. 1.

It is understood that the device is intended as a toy or amusement device for children. It may be described as a convertible robot. It may be described as a convertible ride-on toy.

Figure 2:
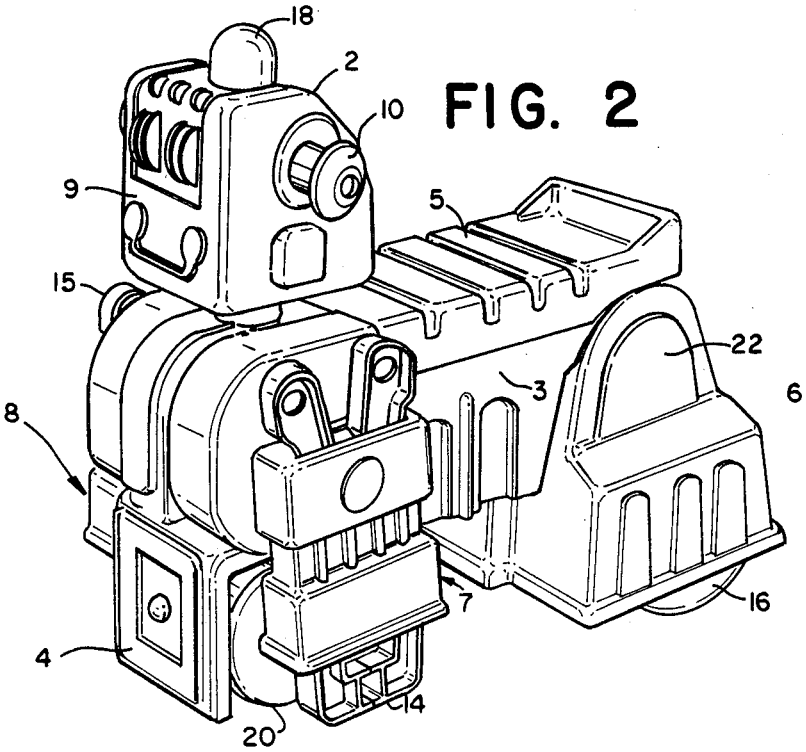
FIG. 2 is a perspective view of the Ride-On Robot taken from the right front and above, showing the device in the rideable condition.

FIG. 2 best shows the general appearance and utility of the device in its condition as a riding toy. In the condition shown in FIG. 2, the device is of such size and strength of construction so that a child, typically of ages one and a half to five years, may sit upon the back of the toy and propel the toy on its wheels, by the child producing a walking motion with his legs and feet.

Figure 1:
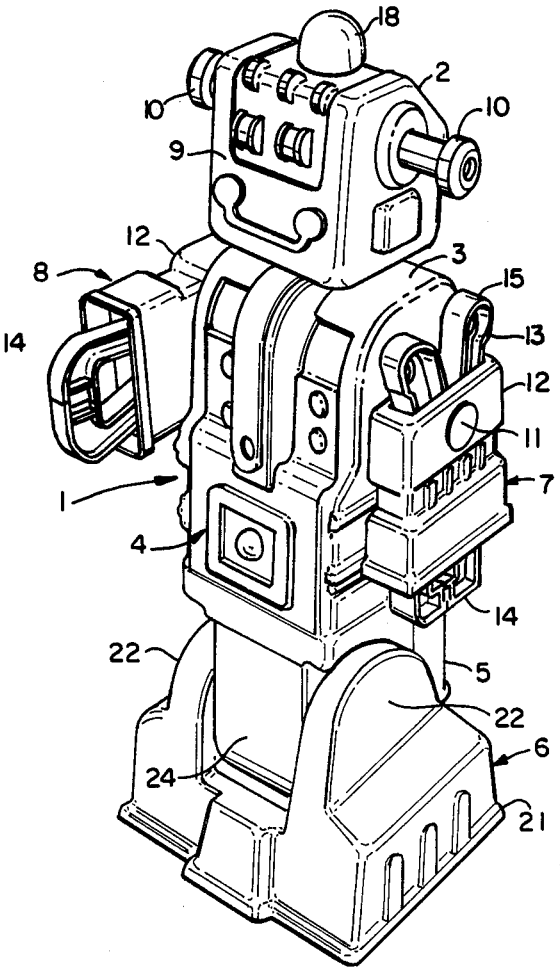
FIG. 1 is a perspective view of the preferred embodiment of the Ride-On Robot, taken from the right front and above, showing the device in the robot-like erect condition.

The device is best illustrated in an overall way in its upright or robot-like position, as best shown in FIG. 1. The ride-on convertible robot is generally designated 1. Its parts, except where they would necessarily or obviously be made of other materials, or unless otherwise described, are made of molded plastic, preferably polystyrene, of sufficient thickness to support the weight of a child wherein the riding configuration. The exact materials of construction need only be suitable for the purpose.

The robot 1 comprises a head 2, a main body portion 3, a front or front body portion 4, a back or back body portion 5, a base 6, a left arm or left arm assembly 7, and a right arm or right arm assembly 8. The above are all general designations of main parts, which may have subsidiary elements.

The head 2 has a face 9. As shown, the face 9 comprises human face-like features, such as a mouth, eyes, and hair or eyebrows. The exact appearance of such features is not critical to this invention, and a typical or exemplary form is shown herein. The head 2 also includes, on each side thereof, protruding handles or ears 10. As shown, these each comprise a round horizontal shaft with an expanded outer end. Each handle shaft slides freely in and out of a hole in the head 2. Any convenient means, such as an expanded flange on the inner end of each handle 10, prevents the handle from being fully withdrawn from the head. In the upright position, the handles 10 may be left in or out to represent ears, or may be grasped by the child to pull the robot along.

Figure 3:
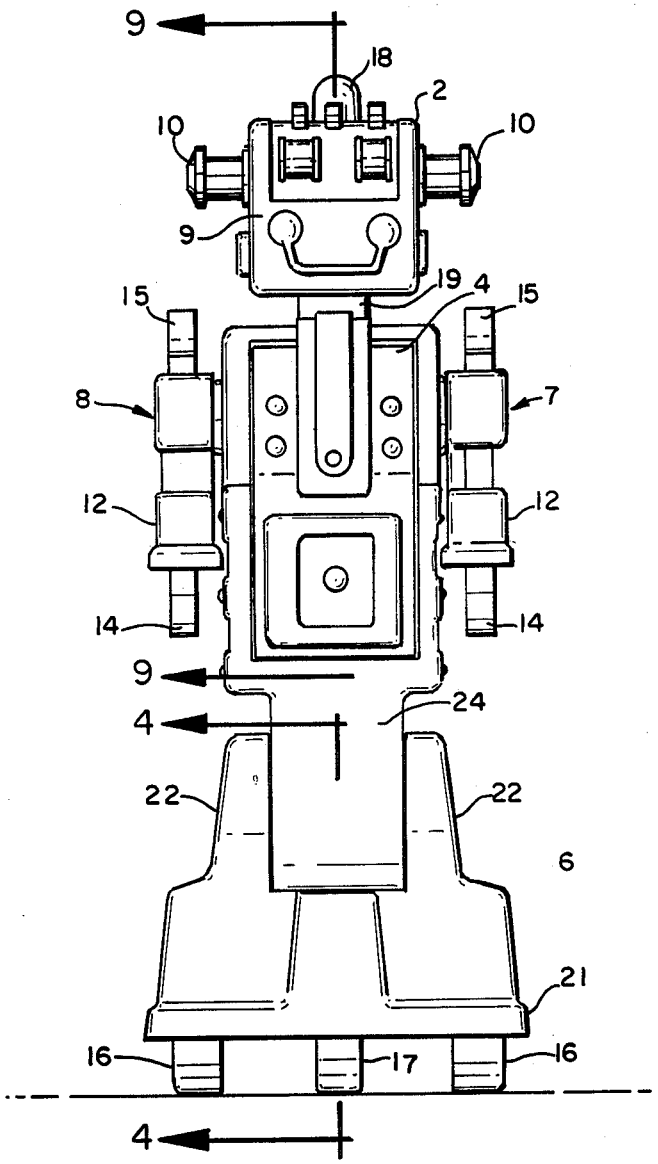
FIG. 3 is a front elevation of the Ride-On Robot in its erect condition.

FIG. 3 is a front elevation view of the robot in its upright position, and together with the showing of FIG. 1 best illustrates the general outward construction of the device.

Each of the arm assemblies 7 and 8 are pivotally mounted to the body or main body portion 3 near the upper end of each arm. Details of the structure of the arm and its mounting are described below, but part of the structure can be appreciated from FIGS. 1 and 3. The pivot means of each arm is concealed by a pivot cap 11, described in more detail in connection with FIG. 8 below. Each arm is capable of being swung around the pivot in a vertical plane in either direction. The structure, as described below, permits the arms to remain in selected angular positions, by means of detents, although the child can override the retention effect of the detent by additional force. In FIG. 1, the right arm 8 is shown partially raised, where it remains until moved. Each arm comprises a sleeve or sleeve portion 12. A hand and hand actuating mechanism is operatively retained said sleeve 12. This structure generally comprises for each arm a pair of hand and actuator means 13. As shown, one of the pair is rearward and the other of the pair is forward. At the lower end of each hand and actuator 13 is a finger 14. As shown, the fingers 14 of each of the pair of hand and actuators 13 face toward in an opposing relationship. The upper portion of each hand and actuator means 13 is shown extending above the sleeve 12 and is described as a hand control or hand control means 15. The normal position of the hand assemblies is as shown in FIG. 1, with the fingers touching each other, that is, with the hands "closed". The child, by squeezing together the upper portions, that is, the hand control means 15, may open the fingers against a resilient bias. The structure and operation of the hands is further shown and described in connection with FIG. 7.

FIG. 3 best initially shows the provision of the wheels which are the sole support of the robot in the upright configuration. There are a pair of rear wheels 16. As shown, these respectively disposed toward the left and right sides at the bottom of the base. The third wheel is a single wheel front wheel 17 which is behind the wheel 16 and is centrally disposed. The wheels are further disclosed in connection with FIG. 4. This group of wheels is generally considered to be the base wheels. When the toy is in its riding configuration, the set of base wheels may properly be considered as the rear wheels of the toy considered as a vehicle or riding device. The robot in the upright position may freely be rolled upon its base wheels.

Out of the top of the head 2 projects a knob or button 18. This button may be depressed by hand pressure of the child. When this is done, the device may be pivoted so that it may reach the riding configuration. Until the button 18 is depressed, the device is locked into its upright position. The structure and operation of this locking and pivoting mechanism is described below in more detail.

The horizontal or vehicle or ride-on or riding configuration of the device is best generally shown in connection with FIG. 2.

To get back from the upright configuration shown in FIG. 1 to the riding configuration shown in FIG. 2, the child or other user presses down on the button 18. The unlocks or unlatches a mechanism described below, so that the child may tilt the head 2 of the toy backwardly. The head 2 and the front body portion 14 pivot as a unit around a pivot point coincident with the pivot point for the arms. The head 2 is connected to the front body portion 14 by means of a neck 19. An effect of tilting the head 2 backwardly toward the back portion 5 is to tilt the front body portion 14 forwardly on the other side of the pivot.

When the head and front assembly have rotated through approximately 90 degrees, so that a line through them forms substantially a right angle with the plane of the back 5, the head and front body portion assembly latches or locks into its new position. A pair of left and right arm wheels 20 are mounted for rotation. They are concealed behind the front body portion 14 when the robot is in its upright position, but are exposed as shown in FIG. 2, when the device has been swung to its riding position. The pair of arm wheels 20 then comprise the front wheels of the toy as a riding device. For ease of nomenclature, the wheels 20 are generally described arm wheels, and the wheels 16 and 17, described above in connection with FIG. 3, are generally called base wheels. In the FIG. 2 configuration, the arm wheels and base wheels all lie on a common horizontal plane and permit the toy to roll on the floor. It is apparent that a child may sit on the back 5 and push the toy by the action of the child's legs and feet against the floor.

In the FIG. 2 configuration, the head 2, the neck 19, and the arm wheels 20 operatively may be turned together in a horizontal plane, around a pivot line extending upwardly through the neck 19, and typically through a limited displacement angle, typically less than 90 degrees. Thus, the child, by grasping the handles 10, and applying a turning force to the head, can steer the toy by changing the alignment of the arm wheels 20.

It is apparent that in the riding configuration, the arms or arm assemblies 7 and 8 may be rotated to the vertical orientation shown in FIG. 2 so as to provide a sort of "fender" appearance, or they may be swung to a forward facing or some other position for different effects.

Figure 4:
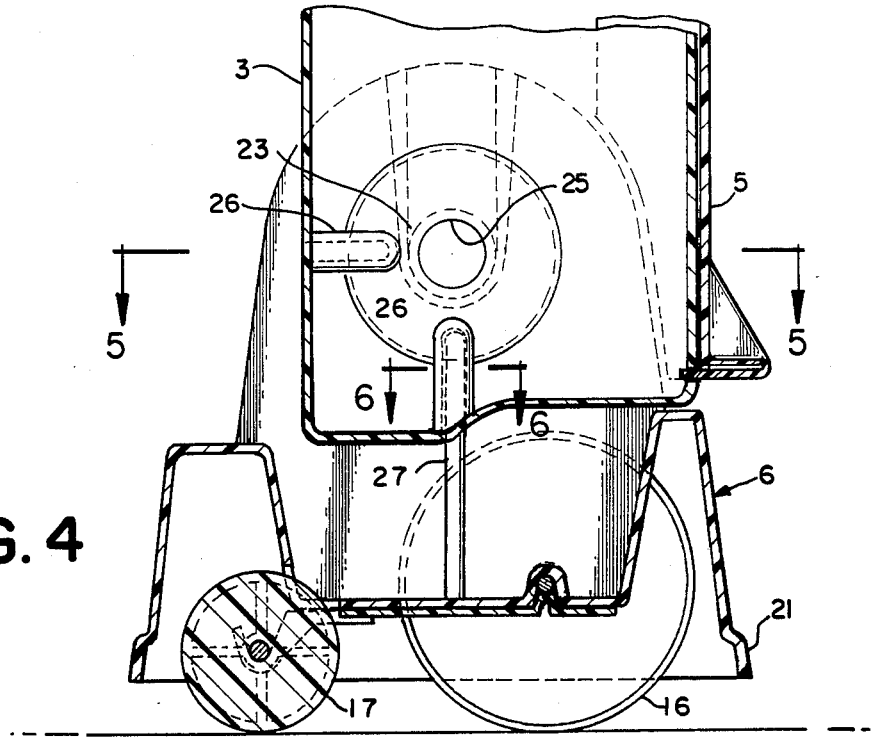
FIG. 4 is a cross-sectional view, partially fragmented, taken along line 4—4 of FIG. 3.

The structure and operation of the base 6 is best understood in detail in connection with FIG. 4. This is a cross-sectional view, partially fragmented, taken along line 4—4 of FIG. 3. The centered front wheel 17 is mounted for rotation on its own axle. The left and right rear wheels 16 of the base wheel assembly are mounted preferably on a common axle. The base 6 has a skirt 21. It also has a pair of upstanding hub sections 22 as best shown in FIGS. 1 and 3. Each hub section is provided on its inwardly facing surface with a bearing hole 23. This structure and associated structure described below are best understood in connection with FIG. 4 and with FIG. 5, taken along line 5—5 of FIG. 4, and also FIG. 6, taken along line 6—6 of FIG. 4. The main body portion 3 is dimensioned so that its lower end fits within the hub sections 22 of the base 6. The lower section 24 of the body 3 is provided on each side thereof with a stub axle 25. Each stub axle 25 fits within the bearing hole 23 of the base, and provides for relative rotation.

The lower section 24 of body 3 is provided, adjacent each stub axle 25, with two alignment grooves 26. One of these, in the FIG. 4 mode, is disposed vertically and the other is at right angles thereto, disposed horizontally. Each hub section 22 of base 6 is provided with a single alignment ridge 26, facing inwardly. When the device is in its upright position, as shown for example in FIGS. 1, 3, and 4, the alignment ridge 27 latches into the vertically disposed alignment groove 26 so that the base 6 and the lower section 24 are held in the upright configuration. The natural yielding qualities of the material permit this latching to be overcome by increased pressure, so that the alignment groove and alignment ridge together form a detent means. When the device is rotated to the riding configuration as shown in FIG. 2, the alignment ridge 27 then slips out of the alignment groove 26 shown vertically in FIG. 4 and into the alignment groove shown horizontally in FIG. 4. Of course, when in the riding configuration as shown in FIG. 2, the horizontal alignment groove 26 as shown in FIG. 4 has been rotated so that it is vertical. Thus, the base has two stable detent positions, depending on the upright or riding configuration of the toy.

The left and right arms are identical in construction and only one need be described. In addition to the description above, the arm construction and operation are best understood in connection with FIGS. 7 and 8. As has been described, each arm assembly 7 and arm assembly 8 comprises a pair of hand control portions 15. These may also be described as arm control portions 15. Each of these arm or hand control portions 15 is an elongated lever-like device, having a pivoted point approximately but not critically near the mid point of length of the control 15. For each arm assembly, a pair of the controls 30 are provided, in opposed relationship to each other as best shown in FIG. 7. The bottom portion of the control 15 is an inwardly facing finger 14. Together, the pair of opposed fingers 14 may be described as a hand 31 by analogy to human anatomy.

Each control 15 has preferably an arm control hole 30 near the upper end thereof. This hole 30 is simply an additional convenience so that a child may hook his or her fingers into the holes to operate the hand 31. The control 15 is bent or extended inwardly near its mid point and is provided with a control pivot hole 32. In the assembled condition, these control pivot holes 32 are aligned.

Figure 8:
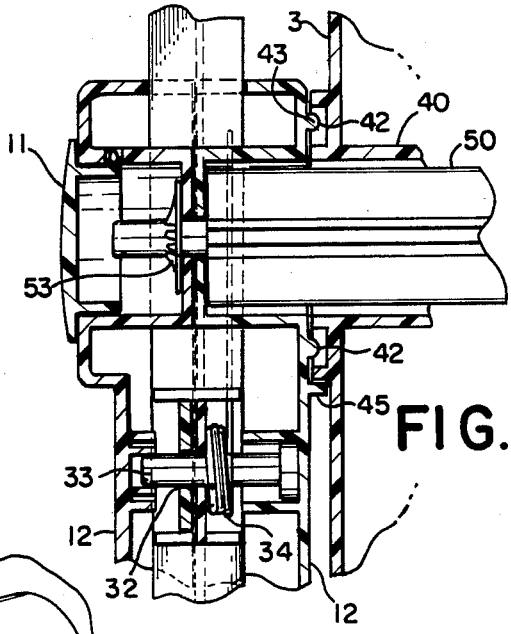
FIG. 8 is a cross-sectional view, partially fragmented, taken along line 8—8 of FIG. 7.

As has been briefly explained above, a hollow sleeve 12 is provided to partially contain the controls 15. The sleeve 12 is provided with a pin 33, as best shown in FIG. 8. The pin 33 serves as an axle. The control pivot holes 32 of each of the hand or arm control portions 15 of the pair are aligned and positioned over and around the pin 33 so that the controls 15 may pivot around pin 33 to their mechanical limits. A resilient or biasing means is provided to normally urge the fingers 14 to bear against each other. In the preferred embodiment, this resilient or biasing means is preferably a hair pin spring 34. As perhaps best shown in FIG. 7, the hair pin spring 34 loops around the pin 33, and the spring arms extend upwardly into the controls 15, where they bear on any convenient solid portion of the controls. In the embodiment shown, the controls 15 are flanged elements, and the extended ends of the hair pin spring 34 bear against the sides of the respective flanges. It is apparent that the natural outward resilient tendency of the hair pin spring 34 tends to pivot the controls 15 so that the fingers 14 tend to move together and the upper portions tend to move apart. Thus, the normal position of the hand 31 is closed. When the child squeezes the upper portions together, either by hooking his fingers into the control holes 30 or otherwise, the fingers open, and when the pressure is released, the fingers close and may grasp objects.

It will be appreciated from FIG. 8 that the circular portion of the hair pin spring 34, disposed pin 33, is shown in solid lines. The arm or extension of that circular or coiled portion of the spring is shown extending upwardly, partially in broken lines because it is obscured by other parts. It is also apparent from FIG. 8 that the sleeve 12 is preferably made in two pieces which fit together so that the structure may be assembled. FIG. 8 also best shows how each arm assembly 7 or 8 is affixed to the body 3 for selective rotation and normal retention in the selected position. The body 3, on each side thereof, is provided with an arm bearing 40. On the outer surface of the body 3, each arm bearing 40 is provided with a boss 41. The boss in turn is provided on its face, circumferentially around the arm bearing hole, with a plurality of arm position detents 42. In a typical embodiment as shown, there are eight such detents 42 with equal angular disposition around the circumference of the boss. This is perhaps shown best in FIG. 7.

The inwardly facing surfaces of each sleeve 12 are provided with a pair of arm position projections 43. In the preferred embodiment, there are two of these projections, disposed on diametrically opposite sides of the arm bearing 40 when assembled. The inner section of the sleeve 12 contains a recess 44. Also, the inner portion of the sleeve 12 is provided with a retaining flange 45 which partially surrounds the boss 41 and contributes to the stability and smooth operation of the structure.

An arm axle 50 is provided. The arm axle 50 projects outwardly through arm bearing 40 and into the recess 44 in sleeve 12. As perhaps best seen in FIG. 7, in the typical embodiment shown, the axle has a cruciform shape in transverse cross-section. At its outer end, each arm axle 50 is provided with a preferably circular arm axle extension 51. This arm axle extension 51 extends into and fits with a sliding fit into a hole in the sleeve 12. A lock washer or lock retainer 53 is forced over the end of the arm axle extension 51 and holds the arm assembly structure to the body. The retainer 53 is a known device, preferably of metal having inwardly disposed points which may be easily inserted in one direction over a pin or shaft but resists withdrawal because the points tend to dig into the shaft.

It is apparent from the foregoing description of structure that each arm assembly 7 or 8 may be pivoted around the arm axle extension 51 in a vertical plane. The arm position projections 43 interact with the arm position detents 42 so as to provide a plurality of fixed retention positions for the arm. These fixed positions may be overridden by the child applying a rotational force to the arm.

Figure 10:
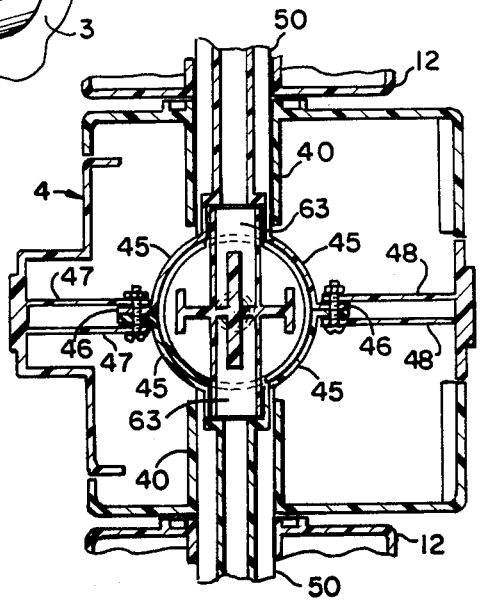
FIG. 10 is a cross-sectional view, partially fragmented, taken along line 10—10 of FIG. 9.
Figure 9:
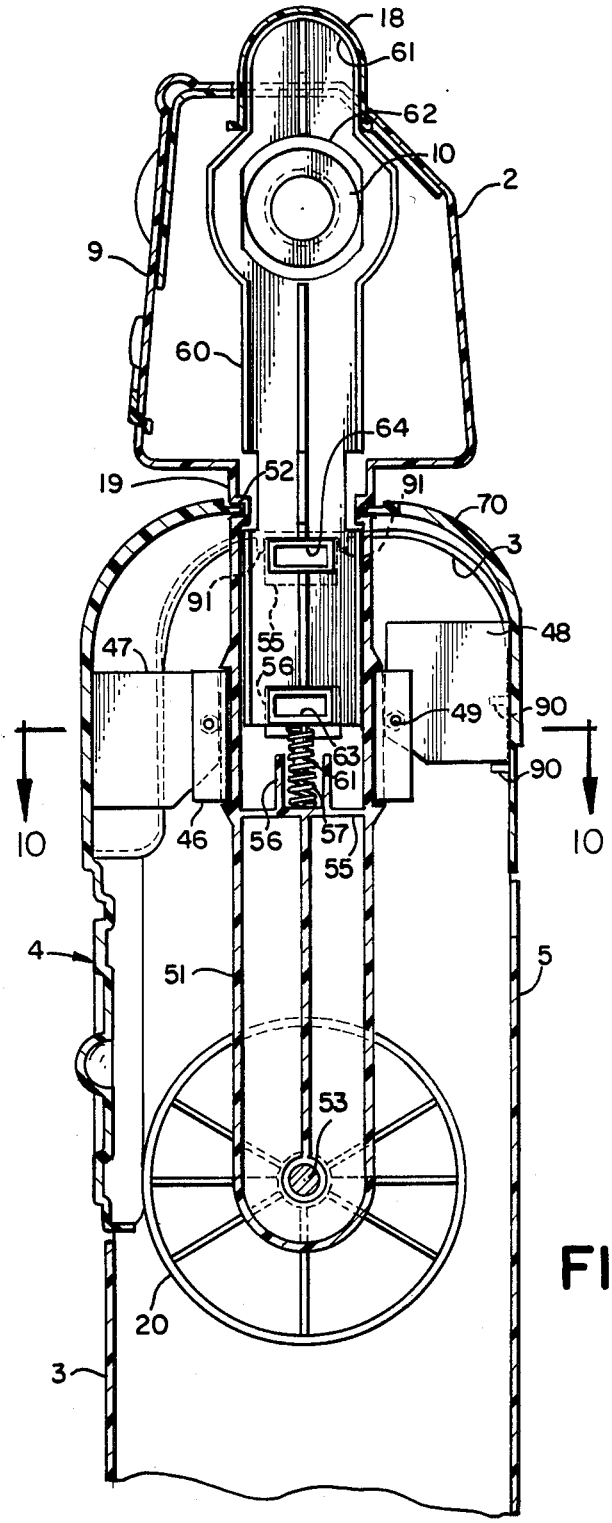
FIG. 9 is a cross-sectional view, partially fragmented, taken along line 9—9 of FIG. 3.

The means by which the sub-assembly of head, neck, and front body portion are tiltable with respect to the main body portion 3, and are selectably latched into one of the two relatships therewith as have been described, to make either the upright configuration or the ride-on configuration is best understood in connection with FIGS. 9 and 10. In addition, the means of attaching the arm axles 50 to the structure are also further best understood in connection with FIGS. 9 and 10. It is apparent that the arm axles 50 are not capable of vertical movement with respect to the body 3, since they pass through arm bearings 40 in the body. Each arm axle 50 terminates at its intermost end in a semi-circular collar 45. Each semi-circular collar 45 is provided with a collar flange 46. A flange extends from each end of the semi-circular collar in a direction transverse to the length of the arm axle 50. There is at least one hole in each flange. In assembly, the semi-circular collars are placed opposing each other, with their respective flanges opposing each other and the holes in the flanges of one of said collars being aligned with the matching holes in the flanges of the other said collar.

The front portion of the toy, generally designated 4 has near its upper extremity a pair of inwardly facing plates 47. There is also provided what may best be termed a front portion extension 70, as best shown in FIG. 9. This is a relatively short curved piece that in comparison with human anatomy, would correspond to a portion of the shoulder centrally located just below the nape of the neck. As can be seen by the break in the structural line on the right just below the section numeral 10 in FIG. 9, this piece terminates before descending very far, and the general outward configuration of the robot, when in the upright position, is continued by the back portion 5. This front portion extension 70, like the front portion 4, has a pair of inwardly extending plates 48. The plates 48, like the plates 47 are provided with an aligned hole through each of the plates. It can now be better appreciated, particularly with reference to FIG. 10, that the collar flanges 46 on the semi-circular collars 45, with their respective holes aligned, may be inserted between each of the plates 47 and 48 respectively, with the holes in those plates aligned with the holes in the collar flanges. Then, a fastening, which may be preferably be a screw and nut 49 is passed through all the holes and secured.

By reference to FIG. 9, it will be seen that the head 2 and the neck 19 are preferably integral, and that the neck 19 is actually just a visible part of a longer and more complex structure called the central post 51. It will be appreciated in general that many parts which are described as unitary are actually preferably fabricated as split parts so that elements may be inserted within them and they may be assembled. Thus, the head, neck and central post which are described as preferably integral, are in a typical preferred embodiment made as two longitudinally vertically split pieces, identical except for handedness. The bottom of neck 19 is defined by a groove 52. It is apparent that the neck portions of the front 4 and the front portion extension 70 fit into the groove 52 to surround the neck. The central post extends downwardly to the point at which the arm wheels are attached. A transverse hole is provided through the central post near the bottom so that the axle 53 may be passed therethrough and carry the wheels 20 for rotation. It will be also be seen from FIG. 9 that the central post 51 is provided near its mid-point (although the exact location is not critical to the invention) with a collar retainer 54. The collar retainer comprises a circumferential area surrounded above and below by outwardly extending flanges. The semi-circular collars 45 with their collar flanges 46 fit within this collar retainer. Thus, the whole assemblage of arms, plates, flanges, and front portion extension is stabilized. For steering or head turning purposes, the central post 51 may be turned around its vertical axis with respect to the semi-circular collars 45.

The central post 51 is provided in addition with two vertically displaced rectangular openings, an upper rectangular opening 55 and a lower rectangular opening 56, shown in a broken line in FIG. 9.

The central post 51 also is provided with a cross piece 55 located at the lower edge of the collar retainer 54. The cross piece 55 preferably includes upstanders 56 which serve to generally retain a helical spring 57.

A central actuator 60 is provided. This is a longitudinally extended element that runs vertically through the head to and into the central post 51, but terminates short of the cross piece 55 in central post 51. At the top of central actuator 60 is a dome 61. The dome 61 projects upwardly through a hole in the top of the head 2. Below dome 61, and within the confines of head 2, actuator 60 is provided with a aperture 62 so that parts of the ears or handles 10 may clear it without interference. Further down along central actuator 60, and below the groove 52 and central post 51, two pairs of vertically displaced horizontally projecting studs are provided. There is a lower pair of studs 63, as best shown in FIG. 10, extending toward the right and left, diametrically opposed to each other, outwardly from the central actuator 60. Located above the lower studs 63 are a substantially identical pair of upper studs 64, as best shown in FIG. 9. It will be appreciated from these two figures that the total of four horizontal projections comprising the upper and lower studs in a typical embodiment retangular in shape. It will also be appreciated from FIG. 9 that the rectangular openings 55 and 56 in the central post 51 are wider than the studs 63 and 64 to permit steering, and in the vertical dimension, the rectangular openings are large enough to permit limited movement in a vertical direction of the studs. The central actuator 60 is of a general cruciform cross-section.

A centering pin 61 forms the bottommost part of the actuator 60. As best shown in FIG. 9, the centering pin engages the center of the helical spring 57 and tends to keep the elements aligned. The dome 61 is covered by the knob or button 18. The button 18 rides on the dome 61 and is free to move with respect to the top of the head 2. It is apparent that helical spring 57 and is free to move with respect to the top of the head 2. It is apparent that helical spring 57 biases the central actuator 60 upwards, and that by manual pressure downwardly on knob or button 18, the central actuator 60 may move a short distance vertically downward against the compression of the spring, which tends to bias it back upwardly. Each of the arm bearings 40 have a cut-out along part of the circumference of its inner extension. It is apparent from FIG. 10 that the lower studs 63 project within the inward extent of the arm bearings 40. If it were attempted to rotate the assembly of head, neck, central post and central actuator with respect to the arm bearings 40 without clearance, the studs 63 would interfere with the bearings 40 and prevent such rotation. If however, downward pressure on knob 18 is applied, the central actuator 60 and hence the lower studs 63 move slightly downwardly, and in doing so they clear the innermost structure of the arm bearings 40 by passing downwardly from the cut-out portion therein, and the studs 63 may rotate inside the furtherest extension of arm bearings 40. In FIG. 10, the cut-out or cut-back in each of the arm bearings 40 is above the showings of the studs 63, and the studs 63 move downwardly with respect to the plane of the paper in order to provide the necessary clearance.

As the head, neck, central posts, central actuator assembly is tiled backwardly, that is, with the head moving toward the back of the toy, the upper studs 64 swing backwardly and approach the back body portion 5. When the rotation has reached 90 degrees, the upper studs 64 strike and interfere with the back portion 5. The interference is slight, and preferably, the upper surface of the studs 63 contacts inwardly facing ridges or irregularities or protrusions 90 on the inside surface of body 3, on the back thereof, and together a detent effect is produced. As the turn is completed, and the upper stud 64 interferes with the body 3 by engaging the pair of ridges 90, there may be a slight compression of the helical spring 57. A sufficient locking effect is thus produced to thus provide sufficient stability in the ride-on position.

It will be appreciated therefore that the toy, in its upright or robot-like position is locked and is stable in that position. When the child presses the button 18, the lower stud clears the inward projection of arm bearing 40 and the structure is unlatched or unlocked for manual rotation backwards as has been described in connection with FIG. 2. As has been described, the structure then tends to be retained with sufficient stability in the ride-on position shown in FIG. 2.

As best shown in FIG. 9, a pair of ridges 91 extends downwardly and inwardly from the center top of the body 3. In the upright position, the upper studs 64 engage the ridges 91 and help resist rotation unless released as described. Application of pressure to button 18 also serves to release the studs 64 from upper ridges 91.

Another application of pressure on knob 18 serves to release the interference between the upper studs 64 and the lower ridges 90 on the body 3, and permits the structure to be returned to the upright position as shown in FIGS. 1 and 3.

Figure 11:
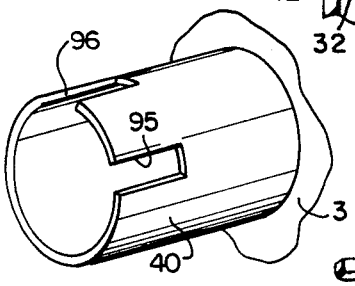
FIG. 11 is a perspective view, partially fragmented, of an alternate embodiment of the arm bearing.

FIG. 11 shows an alternate embodiment of the arm sleeve 40, shown mounted on a fragmented showing of body 3. In this embodiment, there is a horizontal notch 95 and an upper vertical notch 96. As shown in FIG. 11, each of these notches is a rectangular cut-out extending along the arm bearing 40 from the inwardly facing open end of the arm bearing 40. The dimensions of each notch are sufficient to accomodate partial insertion of the upper studs 64.

It will be appreciated that there are two latching means for the upright position and two latching means for the ride-on position. One of the latching means is the partial insertion of an upper stud 64 into the upper vertical notch 36, for latching in the upright position, and into the horizontal notch 95 for latching into the ride-on position. As has been described, pressure on the button 18 moves the studs 64 inwardly towards the center of the arm bearing 40 and permits it to clear its interference with the arm bearing 40, and therefore permits it to rotate from alignment with one notch to the other.

The other latching means is the selective engagment of the lower studs 63 with either the lower ridges 90 or the upper ridges 91. In the upright position, the upper studs 64 engage the upper ridges 91, and the engagement is sufficiently released to permit rotation when the button 18 is pressed. In the ride-on position, the upper studs 64 engage the lower ridges 90 and sufficient relief from the engagement to permit rotation is provided when the button 18 is pressed.

Thus, the two stable configurations of the device may be attained by reliance on both the ridge type and notch type engagements, or by either type, or by a combination of the types.

For the greater strength and stability, the preferred embodiment is one in which the ridge and notch types of latching are both used in the upright configuration as well as the ride-on configuration.

Alternate embodiments, in which only one of the latching types is used or in which a combination of the latching types is used, are also workable and practical. The manufacturing techniques and considerations and economic considerations may dictate that less than two latching types are used for each configuration. For example, the ridge engagement may be relied on for both latchings, or the ridge engagement may be relied on for one configuration and the notch engagement for the other configuration. It has even been found possible to have a workable device in which the ridge engagement is used for the ride-on configuration, and no positive latching device is used in the upright configuration, internal friction and the general limitations of freedom of movement of the parts being relied on. This later alternate embodiment is not as preferable, but is within the scope of the invention.

From a functional point of view, the dual latching means is preferred. From the point of economics of manufacture, the omission of one or more latches has a preferable aspect. Therefore, it is really difficult to assign the order of preference, with different factors being applicable in each of the embodiments. They all are within the scope of the invention.

It will be appreciated that in the upright position an attractive robot is provided, which can be wheeled along, and which can move its arms and can grasp objects in its fingers. In the ride-on position, the device still has a humanoid appearance but it is then usable as rideable vehicle or toy. The child may sit on the back and may grasp the handles and may turn the head and hence turn the front or arm wheel assembly for limited steering. In addition, the arm and hand structure may be used in the ride-on condition as well as the upright position.

I claim:

1. A ride-on convertible robot comprising a body, a base below said body, a base wheel assembly on said base, an integrally moveable head, neck, front portion, and arm wheels, said robot having a selectable upright configuration and a rideable configuration, said arm wheels being concealed within said body when said robot is in said upright configuration and said said arm wheels and said base wheel assembly comprising forward and rear floor-contacting wheels when said robot is in said rideable configuration.

2. A robot as set forth in claim 1 wherein a pair of arms are provided on said body, said arms being articulated in a vertical plane and having manually operable hands, each said hand being normally biased in a closed and grasping position by resilient means and having hand control means squeezable to open said hands against said resilient means bias.

3. A robot as set forth in claim 2 wherein each said arm comprises an opposed pair of arm control elements, each said arm control element including a pivot hole and a finger at the lower end thereof, and said resilient means biases the upper ends of said control elements away from each other.

4. A robot as set forth in claim 3 wherein said resilient means comprises a hairpin spring having arms, said arms bearing outwardly against each said control element above said pivot hole.

5. A robot as set forth in claim 1 wherein selection means are provided to selectively retain said robot in either said upright or said rideable configuration and to permit change from one to the other configuration, said selection means including a vertically moveable central actuator, said robot being released from said retention upon downward vertical movement of said central actuator.

6. a robot as set forth in claim 5 wherein said selection means includes a spring exerting an upwards force, said spring bearing against the lower end of said central actuator and opposing downward vertical movement of said actuator, the bias of said spring tending to keep said robot in a said retained position.

7. A ride-on convertible robot comprising a body, a base below said body, a base wheel assembly on said base, a moveable head, neck, front portion and arm wheels, said robot having a selectable upright configuration and a rideable configuration, said arm wheels and said base wheel assembly comprising forward and rear floor-contacting wheels when said robot is in said rideable configuration, means to selectively retain said robot in either said upright or rideable configuration and to permit change from one to the other configuration, said selection means including a vertically moveable central actuator and a manually operable button operatively connected thereto, whereby pressure on said button moves said central actuator vertically.

8. A robot as set forth in claim 7 wherein said selection means includes a spring exerting an upwards force and bearing against the lower end of said central actuator and opposing downward vertical movement of said actuator.

9. A robot as set forth in claim 8 wherein said selection means includes latching means, said pressure on said button, moving said central actuator vertically against said spring bias, tending to release said latching means.

10. A robot as set forth in claim 9 wherein said head, neck, front portion and arm wheels are pivoted to said body, and wherein said latching means tends to retain said head, neck, front portion and arm wheels against rotation around said pivot relative to said body.

11. A robot as set forth in claim 10 wherein a bearing comprises part of said pivot and said bearing is provided with a notch, and said central actuator is provided with a stud, said stud being configured and dimensioned to fit into and be partially insertable into said notch, comprising a latch, and pressure on said button, vertically moving said central actuator against said spring bias, serving to remove said stud from said notch, whereby said robot is unlatched.

12. A robot as set forth in claim 11 wherein said bearing is provided with a vertical notch and a horizontal notch, and said stud is selectively partially insertable into and removable from each of said notches.

13. A robot as set forth in claim 10 wherein said central actuator is provided with an upper stud, and said body is provided with means to interfere with said upper stud, forming a latch, pressure on said button moving said central actuator vertically, serving to tend to unlatch said upper stud from said interference means.

14. A robot as set forth in claim 13 wherein said interference means comprises a ridge on the interior surface of said body.

15. A robot as set forth in claim 14 wherein a vertical interference means and a horizontal interference means are provided on the interior of said body, each of said interference means comprising a ridge, and said pressure on said button serving to selectively unlatch said upper stud from either of said vertical or horizontal interference means and to permit rotation around said pivot.

* * * * *